US011434679B2

(12) United States Patent
Xiao et al.

(10) Patent No.: US 11,434,679 B2
(45) Date of Patent: Sep. 6, 2022

(54) FOLDING DOOR STRUCTURE

(71) Applicant: Cyber Top Trading Limited, Hong Kong (CN)

(72) Inventors: Yan Biao Xiao, Guangdong (CN); Yau Sing Lai, Hong Kong (CN)

(73) Assignee: CYBER TOP TRADING LIMITED, Hong Kong (HK)

( * ) Notice: Subject to any disclaimer, the term of this patent is extended or adjusted under 35 U.S.C. 154(b) by 967 days.

(21) Appl. No.: 16/177,399

(22) Filed: Oct. 31, 2018

(65) Prior Publication Data

US 2019/0078367 A1 Mar. 14, 2019

(30) Foreign Application Priority Data

Jul. 4, 2018 (CN) ..... 201821058936.X

(51) Int. Cl.
*E05D 15/26* (2006.01)
*E06B 3/48* (2006.01)
(Continued)

(52) U.S. Cl.
CPC ..... *E05D 15/26* (2013.01); *E05B 65/0876* (2013.01); *E06B 3/481* (2013.01); *E06B 3/509* (2013.01); *E06B 3/5018* (2013.01); *E06B 3/924* (2013.01); *E05B 65/0085* (2013.01); *E05D 2015/268* (2013.01); *E05Y 2201/64* (2013.01); *E05Y 2201/684* (2013.01); *E05Y 2900/132* (2013.01); *E06B 3/26303* (2013.01);
(Continued)

(58) Field of Classification Search
CPC ... E05D 15/26; E05D 2015/268; E06B 3/481; E05B 65/0085; E05B 5/0876; E05Y 2900/132
See application file for complete search history.

(56) References Cited

U.S. PATENT DOCUMENTS 4,922,987 A * 5/1990 Marontate ..... E06B 3/481 160/183
5,150,501 A * 9/1992 Pasternak ..... E06B 3/481 16/272
(Continued)

FOREIGN PATENT DOCUMENTS

CN 205172333 U * 4/2016
CN 206190139 U * 5/2017
(Continued)

*Primary Examiner* — Beth A Stephan

(57) ABSTRACT

A folding door structure is provided. The folding door structure includes an upright column, upper sliding bracket and a lower sliding bracket. The upright column is hinged to the door leaves. The folding door structure further includes a first lock component. The first lock component includes a first latch mounted inside the upright column, and both ends of which are extended out from the top and bottom of the upright column to insert into the upper slide and/or the lower slide. By providing a first lock component and an upright column, a first latch can lock the position of the upright column relative to a door frame in a direction of wind pressure. Accordingly, the stress environment of the upper sliding bracket and the lower sliding bracket is improved, and the reliability and the resistance to high wind pressure of the connection mounting structure between adjacent door leaves are improved.

11 Claims, 17 Drawing Sheets

(51) Int. Cl.

| | |
|---|---|
| ***E06B 3/92*** | (2006.01) |
| ***E05B 65/08*** | (2006.01) |
| ***E06B 3/50*** | (2006.01) |
| *E05B 65/00* | (2006.01) |
| *E06B 5/12* | (2006.01) |
| *E06B 3/263* | (2006.01) |
| *E06B 7/23* | (2006.01) |
| *E06B 7/14* | (2006.01) |

(52) U.S. Cl.
CPC . *E06B 5/12* (2013.01); *E06B 7/14* (2013.01); *E06B 7/2307* (2013.01)

(56) References Cited

U.S. PATENT DOCUMENTS

| | | | | | |
|---|---|---|---|---|---|
| 5,472,037 | A * | 12/1995 | Hoffman | E05D 7/009 | 160/183 |
| 9,359,806 | B2 * | 6/2016 | Header | E06B 1/524 | |
| 9,695,623 | B2 * | 7/2017 | Thomas | E05F 15/70 | |
| 10,711,510 | B2 * | 7/2020 | Niehausmeier | E05B 65/0085 | |
| 2010/0012280 | A1 * | 1/2010 | Hans | E05D 15/0656 | 160/405 |
| 2017/0089122 | A1 * | 3/2017 | Lewis | E06B 3/481 | |

FOREIGN PATENT DOCUMENTS

| | | | | | |
|---|---|---|---|---|---|
| CN | 107575131 | A | * | 1/2018 | |
| CN | 108035637 | A | * | 5/2018 | E05D 11/00 |
| CN | 208564327 | U | * | 3/2019 | E05B 65/0876 |
| EP | 3770368 | A1 | * | 1/2021 | E05B 65/0876 |
| KR | 20170001691 | A | * | 1/2017 | |

* cited by examiner

FOLDING DOOR STRUCTURE

CROSS-REFERENCE TO RELATED APPLICATIONS

This application claims to Chinese Application No. 201821058936.X with a filing date of Jul. 4, 2018. The content of the aforementioned application, including any intervening amendments thereto, are incorporated herein by reference.

TECHNICAL FIELD

The present invention relates to the field of window and door fittings for buildings, and in particular to a folding door structure.

BACKGROUND OF THE PRESENT INVENTION

Doors and windows are divided into enclosure members or partition members according to their positions, and have different design requirements, such as heat preservation, thermal insulation, sound insulation, wind resistance, water resistance, fire resistance and other functions. Related measured data have indicated that, in cold areas, the loss of heat from the gaps of windows or doors accounts for about 25% of the whole heat consumption. On one hand, the airtightness of windows and doors is very important in the energy conservation design. On the other hand, since doors and windows are important constituent parts of the enclosure structures of buildings, the doors and windows mounted on an outer surface of a building need to be able to resist against the high wind pressure in the windy weather, need to be able to resist against rain in the rainy weather, and preferably can have thermal insulation when the temperature changes in different seasons.

Folding doors are mainly suitable for workshops, shopping malls, office buildings, exhibition halls, home decoration or other occasions, and serve as partitions or screens. The folding doors may be used as interior doors or exterior doors, and may have the effects of thermal insulation, dust prevention, noise reduction, sound insulation, shielding and the like. The folding doors are beautiful in appearance, novel in style, easy to use and easy to push or pull, and effectively save the floor space.

In the existing folding doors, generally, door leaves are hinged directly by hinges, and upper sliding members and lower sliding members are often mounted at intervals between multiple door leaves. Due to the heavy weight of the door leaves, the stress bearing capabilities of the hinges and the sliding members are highly required. For example, the bearing requirement is satisfied by improving the hinges. For another example, by improving the sliding members, more than four pulleys are provided to adapt to the stress environment.

However, when the existing folding doors are used as exterior doors, the upper and lower sliding members in the connection mounting structure between two adjacent door leaves have the functions of guiding and limiting in a left-right direction, sliding back and forth and bearing the stress, moreover heat insulating strips are provided in an inner cavity of the door leaf profile to realize heat insulation. Thus it is difficult to structurally reinforce the door leaves, and it is difficult for the folding doors to resist against the wind pressure in the windy weather. Therefore, it is necessary to overcome these deficiencies.

SUMMARY OF THE PRESENT INVENTION

To overcome the deficiencies in the prior art, the present invention provides a folding door structure which is able to improve, or at least to a certain extent, the reliability of a connection mounting structure between two adjacent door leaves so that the connection mounting structure can resist against the high wind pressure. The present invention employs the following technical solutions. A folding door structure is provided, including: a fixed frame, an upper slide and a lower slide located on the fixed frame, and a plurality of door leaves sandwiched between the upper slide and the lower slide. The folding door structure further includes an upright column, an upper sliding bracket, a lower sliding bracket and a first lock component;

The door leaves are hinged with the upright column;

the upper sliding bracket is located at an upper end of the upright column and includes an upper pulley and an upper fixed seat, and the upper pulley is fixedly arranged on the upper fixed seat and slidingly provided in the upper slide;

the lower sliding bracket is located at a lower end of the upright column and includes a lower pulley and a lower fixed seat, and the lower pulley is fixedly arranged on the lower fixed seat and slidingly provided in the lower slide;

both the upper fixed seat and the lower fixed seat are fixedly arranged on the upright column, and the upright column is sandwiched between the upper slide and the lower slide through the upper pulley and the lower pulley; and the first lock component includes a first latch, which is mounted inside the upright column, and both ends of which are extended out from the top and bottom of the upright column to insert into the upper slide and/or the lower slide.

Preferably, the folding door structure further includes a central column and a second lock component; two opposite sides of the central column are hinged to the door leaves, respectively; the second lock component includes a second latch and a switch handle; and, the second latch is located within the central column, and the switch handle is located outside the central column, in order to control the second latch to extend out from an end of the central column and then clamp the upper slide and/or the lower slide when the door leaves are closed.

Preferably, the upper slide includes an upper guide groove in an inverted U-shape; the upper sliding bracket includes a left upper sliding bracket and a right upper sliding bracket; the left upper sliding bracket includes a left upper guide pulley and a left upper fixed seat, with the left upper guide pulley being fixedly arranged on the left upper fixed seat; the right upper sliding bracket includes a right upper guide pulley and a right upper fixed seat, with the right upper guide pulley being fixedly arranged on the right upper fixed seat; the left upper fixed seat and the right upper fixed seat are symmetrical in an inverted L-shape and are symmetrically fixed on two opposite wide sides of the upright column; the left upper guide pulley and the right upper guide pulley are arranged in a line and slidingly provided in the upper guide groove; the first latch includes a first upper latch; and, an extended head of the first upper latch is located in the middle of the left upper guide pulley and the right upper guide pulley and resisted against an inner side face of the upper guide groove.

Preferably, the lower slide includes a lower guide groove in a U-shape; tops of two side walls of the lower guide groove are installed with slide rails; the lower sliding bracket includes a left lower sliding bracket and a right lower sliding bracket; the left lower sliding bracket includes a left lower pulley and a left lower fixed seat, with the left lower pulley being fixedly arranged on the left lower fixed seat; the right lower sliding bracket includes a right lower pulley and a right lower fixed seat, with the right lower pulley being fixedly arranged on the right lower fixed seat; the left lower fixed seat and the right lower fixed seat are symmetrical in an L-shape and are symmetrically fixed on two opposite wide sides of the upright column; each of the left lower pulley and the right lower pulley includes a lower guide pulley and two lower bearing rollers; the lower guide pulleys are arranged in a line and slidingly provided in the lower guide groove, and the lower bearing rollers are slidingly provided in the lower guide rails; the first latch includes a first lower latch; and, an extended head of the first lower latch is located in the middle of the left lower pulley and the right lower pulley and resisted against an inner side face of the lower guide groove.

Preferably, the upper sliding bracket further includes an upper hinge sheet which is hinged to the upper fixed seat and fixedly connected to the door leaves; and/or, the lower sliding bracket further includes a lower hinge sheet which is hinged to the lower fixed seat and fixedly connected to the door leaves.

Preferably, the upright column is of a thermal-break aluminum profile structure including an outer cavity, a middle cavity and an inner cavity, and the first latch is mounted in the middle cavity.

Preferably, the folding door structure further includes a reinforcement core which is located in the outer cavity to reinforce the upright column.

Preferably, the central column is of a thermal-break aluminum profile structure including an outer cavity, a middle cavity and an inner cavity, and the second latch is mounted inside the middle cavity; and the folding door structure further includes a reinforcement core which is located in the outer cavity to reinforce the central column.

Preferably, the folding door structure further includes a positioning component which is fixedly provided on the folded opposite faces of two adjacent door leaves to fix a relative position between the two adjacent leaves during folding.

Preferably, drip edge profiles are provided on an outer side of an upper portion of the fixed frame, and drainage holes are formed on an outer side face of a lower portion of the fixed frame.

Preferably, gaskets for sealing the folding door include interlocked compression gaskets.

In the present invention, by providing a first lock component, a first latch can correspondingly fix the upright column, so that the stress environment of the upper sliding bracket and the lower sliding bracket is improved. Therefore, when the folding door structure is used as an exterior door, the reliability of a connection mounting structure between two adjacent door leaves can be improved, the fixation effect becomes better, and the resistance against the high wind pressure becomes better. Consequently, it is beneficial to prolong the service life of the upper sliding bracket and the lower sliding bracket, it is advantageous for the fixation, airtightness and water resistance of the door leaves, and it is also advantageous for the wide application of the folding door as the exterior door on external walls of buildings. By providing a central column and a second lock component, the reliability of the connection mounting structure between two adjacent door leaves can be further improved, and the resistance against the high wind pressure becomes better.

BRIEF DESCRIPTION OF THE DRAWINGS

The present invention will be further described below in detail by specific embodiments with reference to the accompanying drawings.

FIG. 17 is a schematic structure diagram of a cross-section close to a middle portion of a connecting column according to an embodiment of the present invention, in which:

1: hinge; 2: upper sliding bracket; 20: upper guide pulley; 21: upper hinge sheet; 22: upper fixed seat; 3: lower sliding bracket; 30: lower guide pulley; 31: lower hinge sheet; 32: bearing roller; 33: lower fixed seat; 4: clamping member; 5: fastener; 6: drainage hole; 60: drainage hole cover; 61: gasket; 62: glass gasket; 63: interlocked compression gasket; 64: waterproof frame gasket; 7: lock handle; 8: handle; 9: central column; 10: upright column; 100: reinforcement core; 101: inner cavity; 102: middle cavity; 103: outer cavity; 11: upper frame; 110: drip edge profile; 111: upper guide groove; 12: lower frame; 120: bearing rail; 121: lower guide groove; 13: left frame; 14: right frame; 15: positioning handle; 16: first door leaf; 17: second door leaf; 18: third door leaf; 19: guiding sleeve; 190: upper latch; 191: lower latch; 201: left upper sliding bracket; 202: right upper sliding bracket; 301: left lower sliding bracket; 302: right lower sliding bracket; 23: inner aluminum profile; 24: heat insulating bar; and, 25: outer aluminum profile.

DETAILED DESCRIPTION OF THE PRESENT INVENTION

The present invention will be further described below by implementations with reference to the accompanying drawings.

Figure 1:
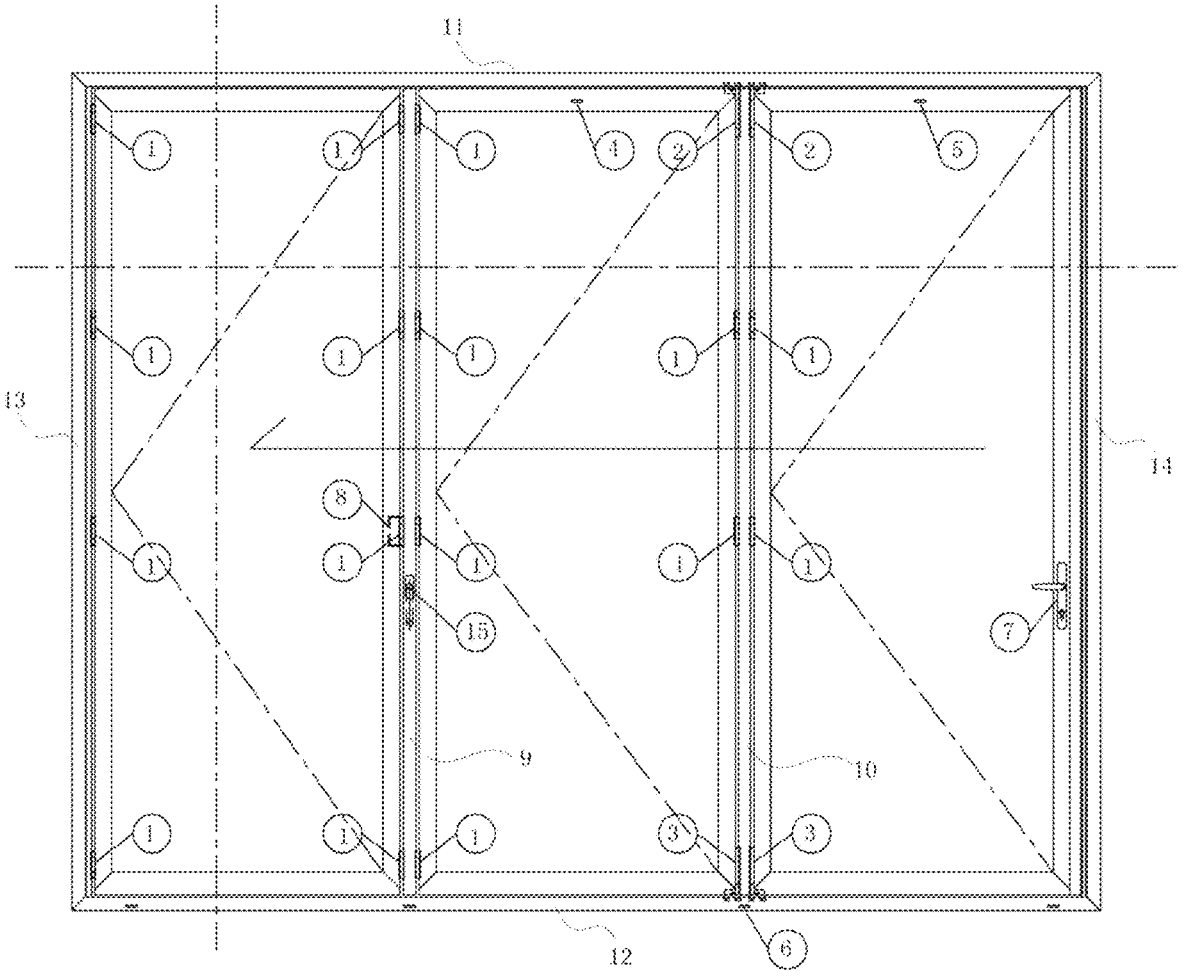
FIG. 1 is a front view of a folding door structure according to an embodiment of the present invention.
Figure 2:
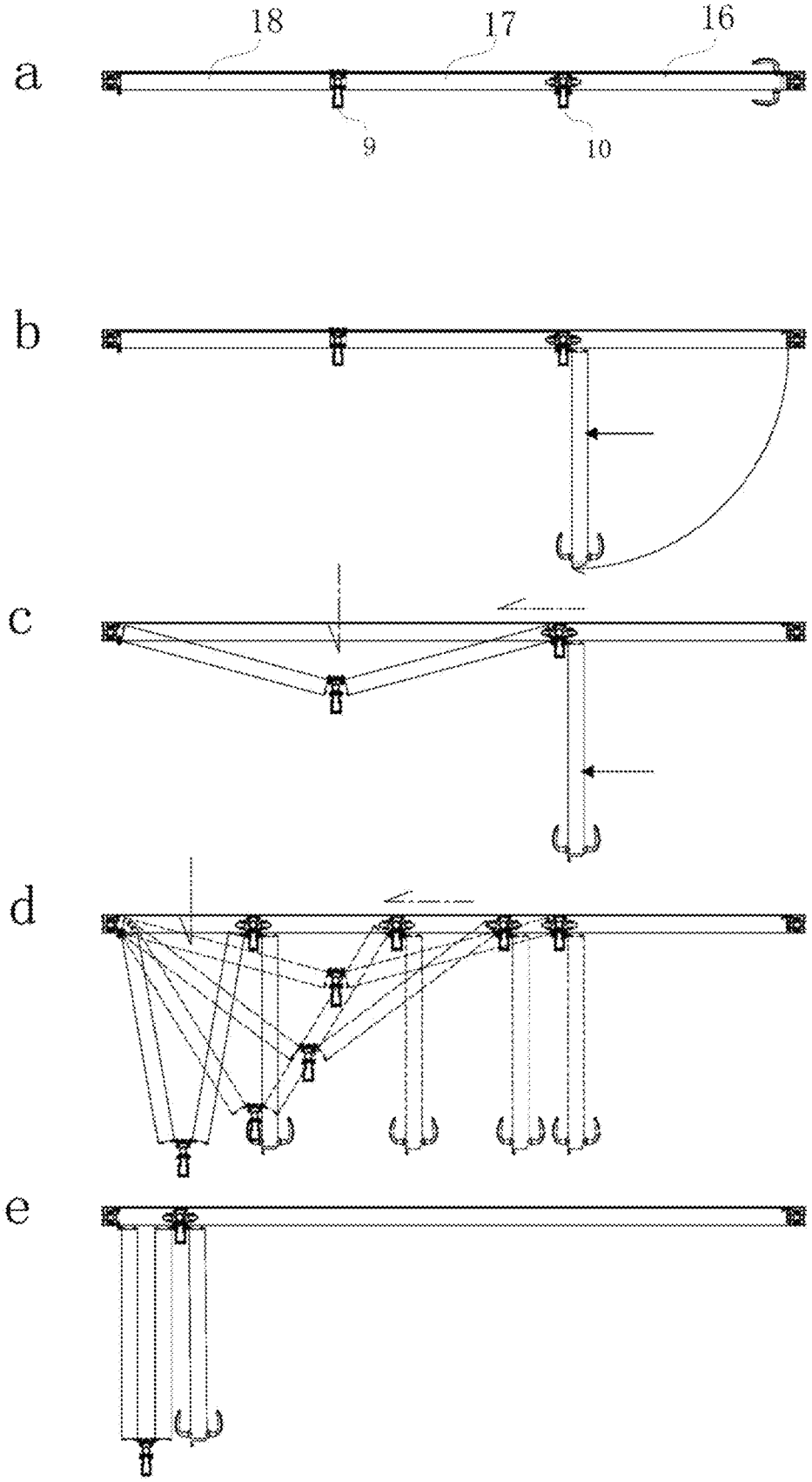
FIG. 2 is a schematic structure diagram of folding steps of the folding door according to an embodiment of the present invention.
Figure 3:
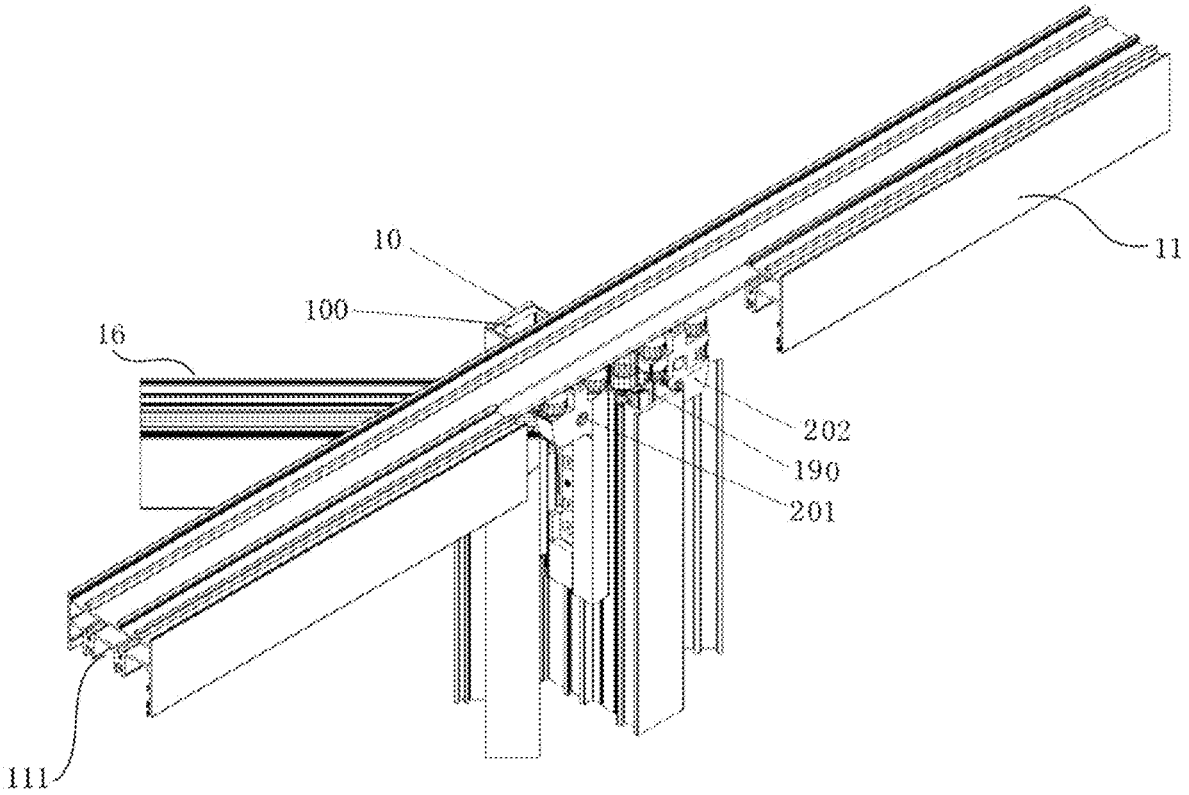
FIG. 3 is a stereoscopic diagram of an upper end of an upright column according to an embodiment of the present invention.
Figure 7:
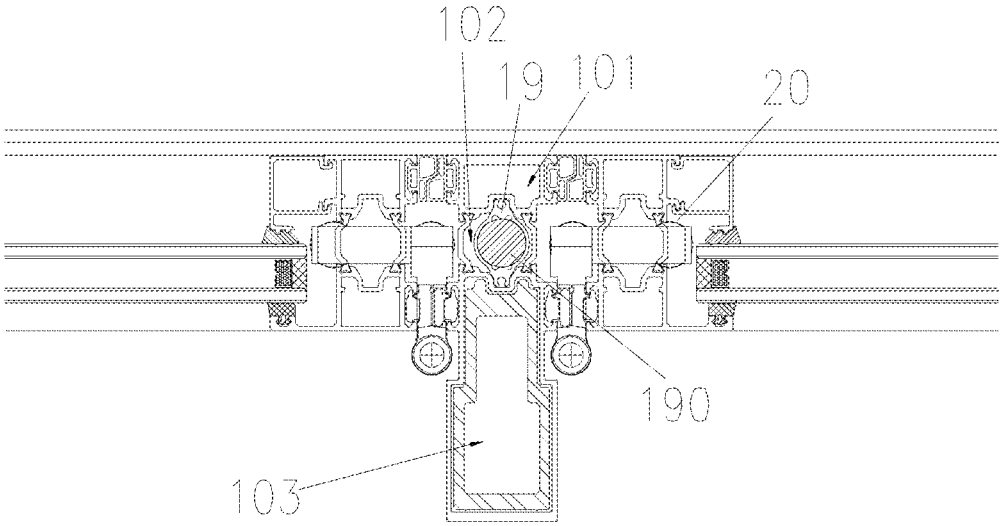
FIG. 7 is a sectional diagram of the upper end of the upright column, when viewed from the bottom, according to an embodiment of the present invention.
Figure 8:
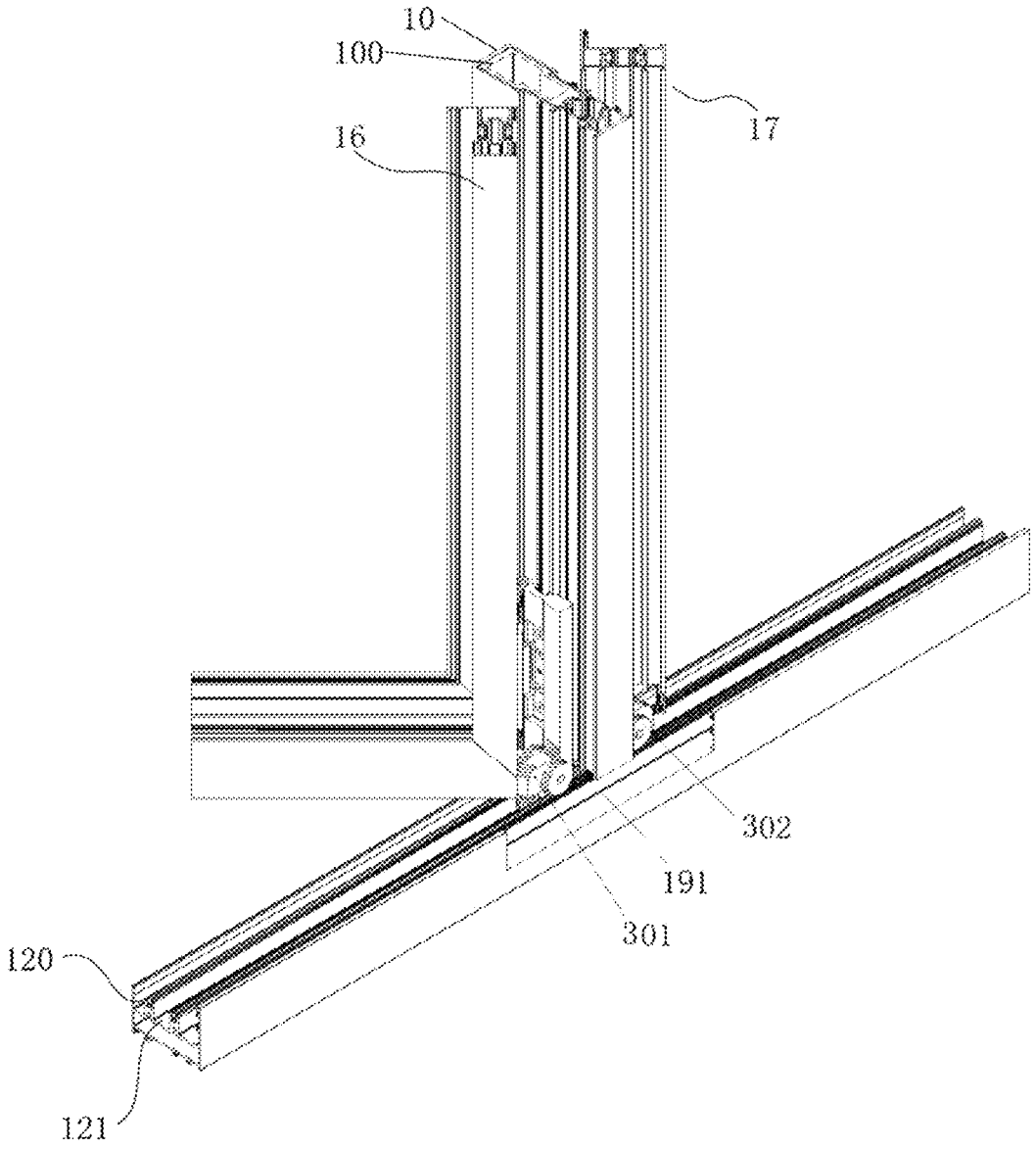
FIG. 8 is a stereoscopic diagram of a lower end of the upright column according to an embodiment of the present invention.

As an example, as shown in FIGS. 1-10, the folding door in this embodiment includes a door frame, door leaves, a connecting column, an upper sliding bracket 2, a lower sliding bracket 3 and a first lock component. The door frame includes an upper frame 11, a lower frame 12, a left frame 13 and a right frame 14. As shown in FIG. 3, the upper frame 11 includes an upper guide groove 111 in an inverted U-shape. As shown in FIG. 8, the lower frame 12 includes a bearing rail 120 and a lower guide groove 121. The lower guide groove 121 is in a U-shape, and tops of two side walls of the lower guide groove 121 are installed with rail 120.

Figure 9:
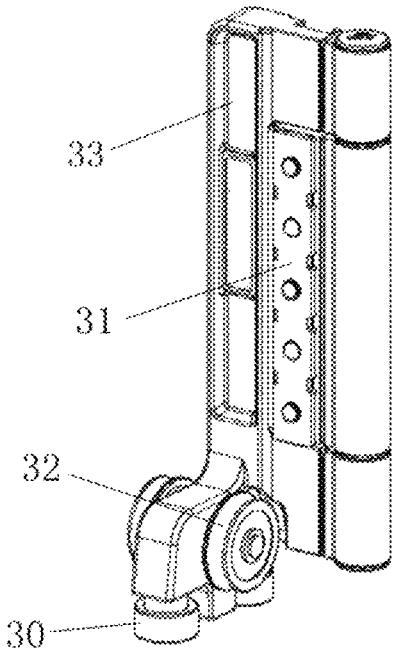
FIG. 9 is a schematic structure diagram of a right lower sliding bracket according to an embodiment of the present invention.
Figure 10:
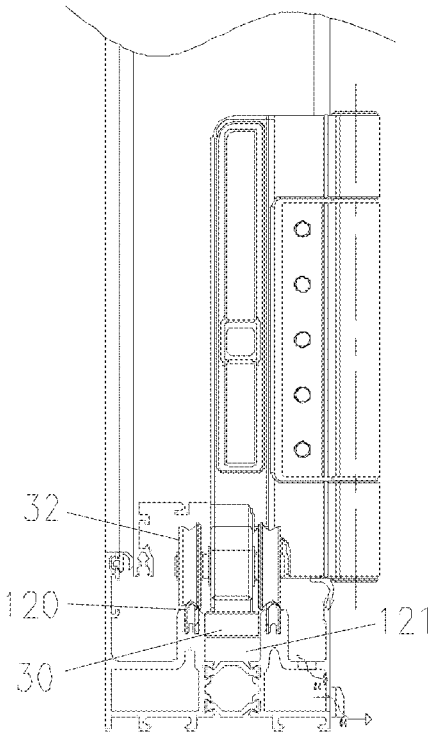
FIG. 10 is a schematic structure diagram of the lower end of the upright column, when viewed laterally, according to an embodiment of the present invention.

The door leaves include a first door leaf 16, a second door leaf 17 and a third door leaf 18. The third door leaf 18 is hinged to the left frame 13 via a hinge 1, both the third door leaf 18 and the second door leaf 17 are hinged to a central column 9, and an upright column 10 as one connecting column is located between the second door leaf 17 and the first door leaf 16, and left and right opposite wide sides of the upright column are hinged to the second door leaf 17 and the first door leaf 16, respectively. An upper end of the upright column 10 is slidingly connected to the upper frame 11 via the upper sliding bracket 2, while a lower end thereof is slidingly connected to the lower frame 12 via the lower sliding bracket 3. Specifically, as shown in FIGS. 3-6, the upper sliding bracket 2 is located at the upper end of the upright column 10, and includes an upper guide pulley 20 and an upper fixed seat 22. The upper guide pulley 20 is fixedly arranged on the fixed seat 22 and slidingly provided in the upper guide groove 111. As shown in FIGS. 8-10, the lower sliding bracket 3 is located at the lower end of the upright column 10, and includes a lower guide pulley 30, bearing rollers 32 and a lower fixed seat 33. The lower guide pullet 30 is fixedly arranged on the lower fixed seat 33 and slidingly provided in the lower guide groove 121. The bearing rollers 32 are fixedly provided on two opposite sides of the bottom of the lower fixed seat 33 and slidingly provided on the bearing rail 120. Both the upper fixed seat 22 and the lower fixed seat 33 are fixedly provided on the upright column 10, and the upright column 10 is sandwiched between the upper frame 11 and the lower frame 12 through the upper pulley and the lower pulley. The upright column 10 can slide along the upper frame 11 and the lower frame 12, so that the door leaves are folded.

More specifically, as shown in FIGS. 3-7, the upper sliding bracket 2 includes a left upper sliding bracket 201 and a right upper sliding bracket 202. The left upper sliding bracket 201 includes a left upper guide pulley 20 and a left upper fixed seat. The left upper guide pulley 20 is fixedly arranged on the left upper fixed seat. The right upper sliding bracket 202 includes a right upper guide pulley 20 and a right upper fixed seat. The right upper guide pulley 20 is fixedly arranged on the right upper fixed seat. The left upper fixed seat and the right upper fixed seat are symmetrical in an inverted L-shape, and are symmetrically fixed on two opposite wide sides of the upright column 10. The left upper guide pulley 20 and the right upper guide pulley 20 are arranged in a line and slidingly provided in the upper guide groove 111. The first latch includes an upper latch 190. A head of the upper latch 190 is located in the middle of the left upper guide pulley 20 and the right upper guide pulley 20, and can resist against an inner side face of the upper guide groove 111 when being extended outward. This structure greatly enhances the resistance against the high wind pressure of the upper sliding bracket.

More specifically, as shown in FIGS. 8-10, the lower sliding bracket 3 includes a left lower sliding bracket 301 and a right lower sliding bracket 302. The left lower sliding bracket 301 includes a left lower guide pulley 30 and a left lower fixed seat. The left lower guide pulley 30 is fixedly arranged on the left lower fixed seat. The right lower sliding bracket 302 includes a right lower guide pulley 30 and a right lower fixed seat. The right lower guide pulley 30 is fixedly arranged on the right lower fixed seat. The left lower fixed seat and the right lower fixed seat are symmetrical in an L-shape, and are symmetrically fixed on two opposite wide sides of the upright column 10. The left lower guide pulley 30 and the right lower guide pulley 30 are arranged in a line and slidingly provided in the lower guide groove 121. The bearing rollers 32 are slidingly provided on the bearing rail 120. The first latch includes a lower latch 191. A head of the lower latch 191 is located in the middle of the left lower guide pulley 30 and the right lower guide pulley 30, and can resist against an inner side face of the lower guide groove 121 when being extended outward. This structure greatly enhances the resistance against the high wind pressure of the lower sliding bracket.

Figure 4:
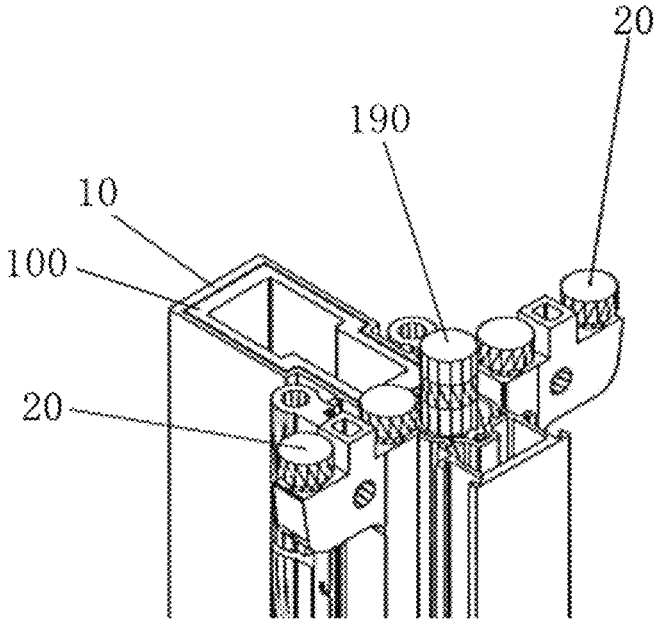
FIG. 4 is a schematic structure diagram of the upper end of the upright column of FIG. 3.
Figure 5:
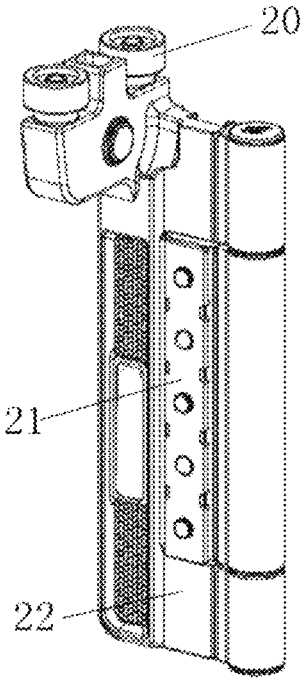
FIG. 5 is a schematic structure diagram of a right upper sliding bracket of FIG. 3.
Figure 6:
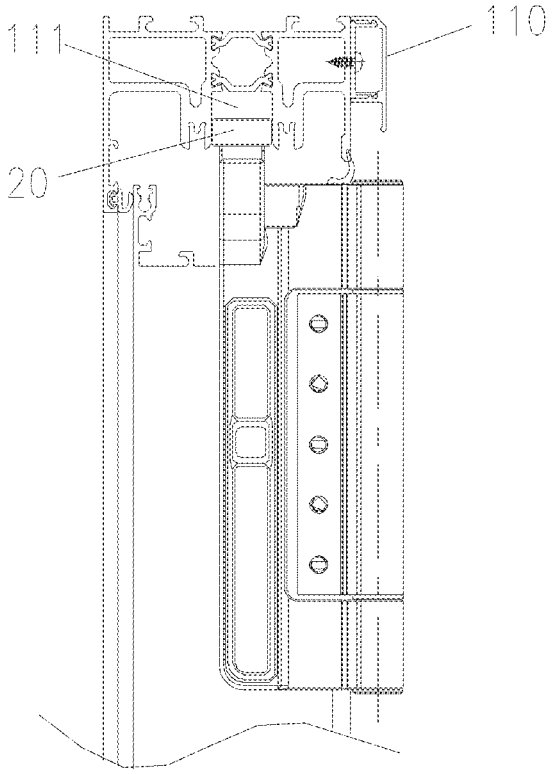
FIG. 6 is a schematic structure diagram of the upper end of the upright column, when viewed laterally, according to an embodiment of the present invention.
Figure 11:
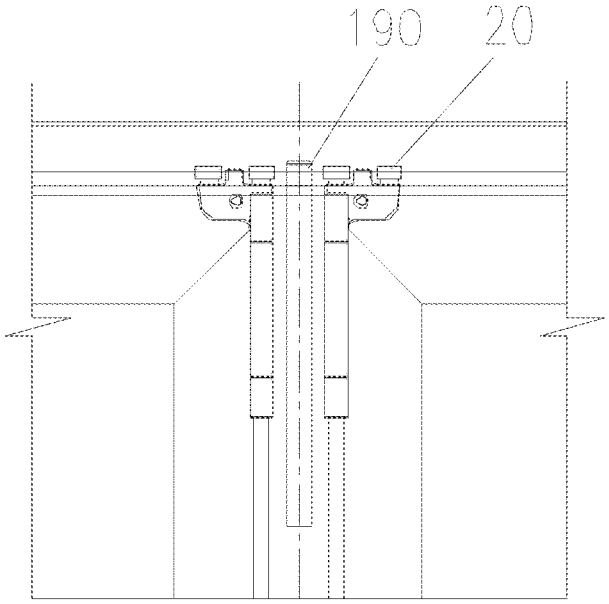
FIG. 11 is a schematic structure diagram of an extended state of an upper latch at the upper end of the upright column according to an embodiment of the present invention.
Figure 12:
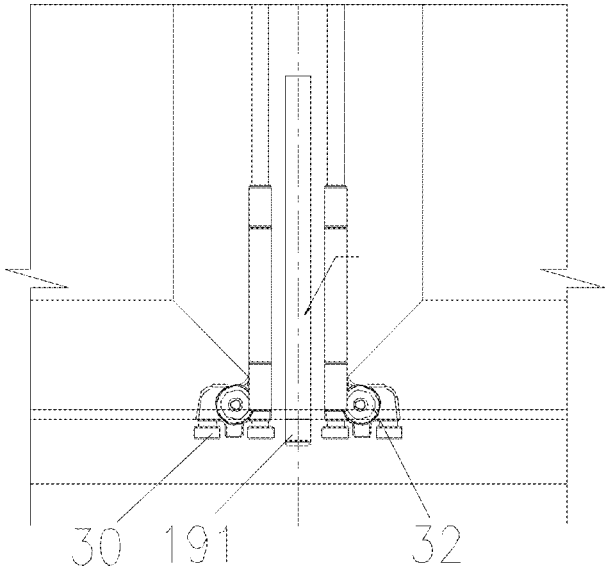
FIG. 12 is a schematic structure diagram of an extended state of a lower latch at the lower end of the upright column according to an embodiment of the present invention.

The first lock component includes a first latch. Preferably, the first latch includes an upper latch and a lower latch. As shown in FIGS. 3, 4 and 7, the upright column 10 is preferably of a thermal-break aluminum profile structure including an outer cavity 103, a middle cavity 102 and an inner cavity 101. The upper latch 190 is horizontally limited by a guiding sleeve 19 and axially fixed in the middle cavity 102. Referring to FIG. 11, an end of the upper latch 190 is extended out from the upper end of the upright column 10 and inserted into an inner wall of the upper guide groove 111. Correspondingly, the lower latch 191 can be arranged with reference to the arrangement of the upper latch 190. The lower latch 191 is horizontally limited by the guiding sleeve 19 and axially fixed in the middle cavity 102. Referring to FIG. 12, an end of the lower latch 191 is extended out from the lower end of the upright column 10 and inserted into an inner wall of the lower guide groove 121. Preferably, as shown in FIGS. 3, 4 and 7, the folding door further includes a reinforcement core 100. The reinforcement core 100 is preferably located in the outer cavity 103 to reinforce the upright column 10. As a preferred implementation of the outer cavity 103, the outer cavity 103 is lengthened. This structure is advantageous for the accommodation of the reinforcement core 100 and the reinforcement, heat insulation and resistance against the high wind pressure of the connecting column.

A lock handle 7 is provided on the first door leaf 16 in order to control the cooperative locking with the right frame 14. The lock handle 7 is preferably a latch bolt capable of controlling an upper position, a middle position and a lower position to realize the cooperative locking with the upper frame 11, the right frame 14 and the lower frame 12, so that the guard against theft, the resistance against wind and the water resistance of the whole door leaves are improved. A U-shaped handle 8 is provided on the third door leaf 18 close to the second door leaf 17, so that it is convenient for folding and pushing/pulling the door leaves.

In this structure, since the second door leaf 17 and the first door leaf 16 are hinged via the upright column 10, the upright column 10 can also be further reinforced according to different requirements on the resistance against the wind pressure. When the extended end of the upper latch 190 and/or the lower latch 191 is resisted against and inserted into the side wall of the upper guide groove 111 and/or the lower guide groove 121, the wind pressure can be endured, and the upright column 10 is fixed correspondingly. Meanwhile, the stress environment of the upper sliding bracket 2 and the lower sliding bracket 3 is improved. Therefore, when the folding door is used as an exterior door, the reliability of the connection mounting structure between two adjacent door leaves can be improved, the high wind pressure can be resisted and the fixation effect becomes better. Consequently, it is beneficial to prolong the service life of the upper sliding bracket 2 and the lower sliding bracket 3, and it is advantageous for the fixation, airtightness and water resistance of the door leaves. Compared with a conventional structure in which adjacent door leaves are connected and mounted only by hinges and sliding members, in this structure, the wind pressure resistance effect becomes better, the stress structure is more rational, and the connection between the door leaves and the upright column 10 is firmer, and it is more advantageous to adapt to the folding environment of the door leaves.

In some embodiments, when there is a plurality of door leaves, the upright column 10 is preferably arranged between two adjacent door leaves, and spaced from the two adjacent door leaves. For example, based on the above embodiment, preferably, the upright column 10, the second door leaf 17 and the first door leaf 16 are used as a door leaf unit, and the door leaves are assembled. During a specific implementation, a plurality of door leaf units can be hinged to each other, and the door leaves are hinged to the door leaf units. The specific number of door leaves can be rationally set according to the width of the door opening. Therefore, there may be various combinations, for example, an odd number+an odd number, an even number+an even number, an odd number+an even number, an odd number+0, or an even number+0. The door leaves can be pushed/pulled and folded in an indoor direction, or can be pushed/pulled and folded in an outdoor direction. Of course, the number of door leaves in each door leaf unit is not limited to 2, and there may be more door leaves.

In some embodiments, based on the above embodiment, as shown in FIGS. 1-2, the folding door further includes a second lock component. The second lock component includes a second latch and a positioning handle 15. The connecting column further includes a central column 9. Left and right opposite wide sides of the central column 9 are hinged to the second door leaf 17 and the third door leaf 18 via hinges 1, respectively, and the central column 9 is located between the left frame 13 and the upright column 10. During the implementation, the second latch can be implemented partially with reference to the implementation of the upper latch 190 and/or the lower latch 191. Specifically, the upper latch 190 and/or the lower latch 191 serves as a latch bolt capable of being telescopically controlled by the positioning handle 15 and is provided in the central column 9, and the positioning handle 15 is provided outside the central column 9 in order to control the second latch to extend out from an end of the central column 9 and then insert into the upper guide groove 111 and/or the lower guide groove 121 when the door leaves are closed. As a preferred implementation, the central column 9 can refer to the upright column 10. The central column 9 is of a thermal-break aluminum profile structure, correspondingly including an outer cavity, a middle cavity and an inner cavity. The second latch is located in the middle cavity. The central column 9 can also be further reinforced with reference to the implementation of the reinforcement core 100 according to different requirements on the resistance against the wind pressure.

When the folding door is folded, the central column 9 can move in a folding direction of the door leaves. When the folding door is closed and after the second latch is extended out and fixed, the wind pressure can be endured, and the central column 9 is fixed correspondingly. Therefore, when the folding door is used as an exterior door, the reliability of the connection mounting structure between two adjacent door leaves can be further improved, the high wind pressure can be resisted, the airtightness and the water resistance are enhanced, and the fixation effect becomes better.

Preferably, any two adjacent door leaves are hinged to the connecting column, and the lock component is used for locking the position of the connecting column relative to the door frame in a direction of wind pressure (a direction perpendicular to the folding door). When the door leaves are completely closed and locked by this structure, both sides of any door leaf are also locked, so that the resistance against the high wind pressure of the whole folding door can be improved greatly. Therefore, when the folding door is used on an external wall of a building as an exterior door, the folding door has the advantages of both a conventional exterior door and a folding door, and has higher applicability, higher security and wider range of application.

Preferably, the split-type upper sliding bracket 2 further includes an upper hinge sheet 21 which is hinged to the upper fixed seat 22 and fixedly connected to the door leaves; and/or, the split-type lower sliding bracket 3 further includes a lower hinge sheet 31 which is hinged to the lower fixed seat 33 and fixedly connected to the door leaves. This structure has a sliding connection function and a hinge joint function. By integrating a conventional hinge with a sliding member, the assembly quality and efficiency can be improved. The bearing roller 32 is preferably made of stainless steel in order to ensure the sufficient strength of the accessories and improve the corrosion resistance.

Figure 13:
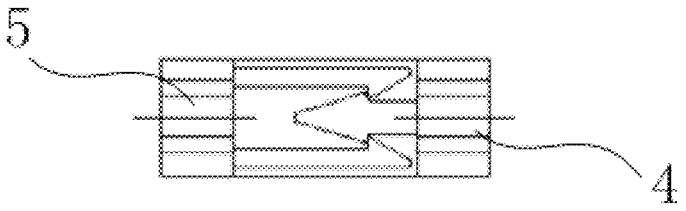
FIG. 13 is a schematic structure diagram of a positioning component according to an embodiment of the present invention.
Figure 14:
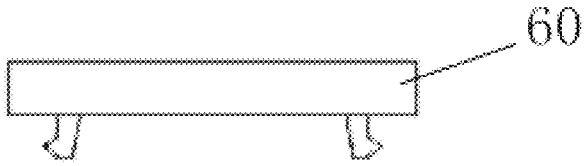
FIG. 14 is a schematic structure diagram of a drainage hole cover according to an embodiment of the present invention.
Figure 15:
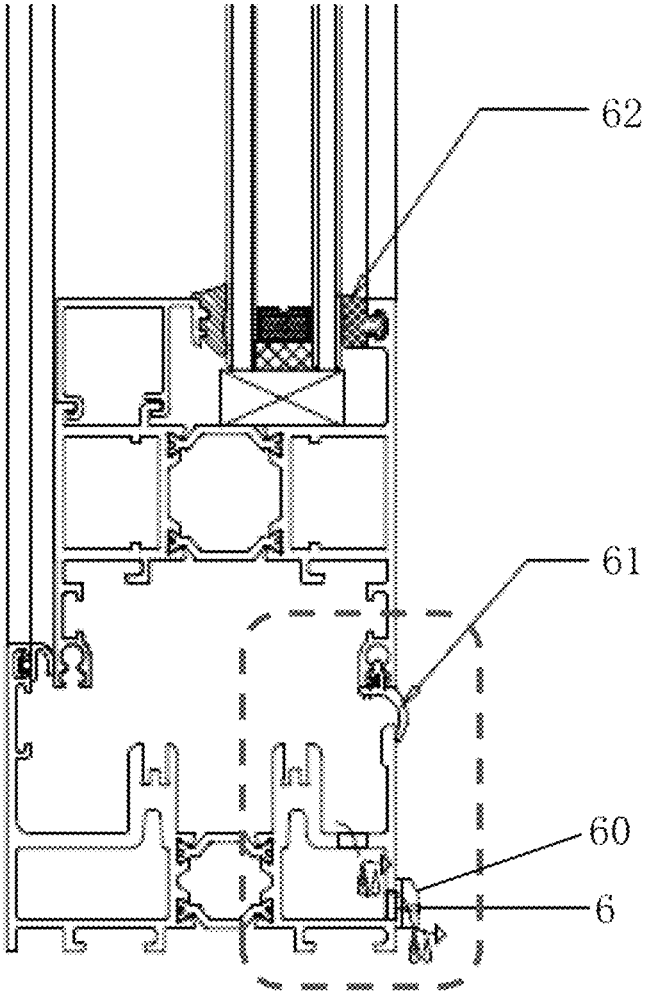
FIG. 15 is a schematic diagram of a drainage structure in a lower portion of the folding door according to an embodiment of the present invention.

Preferably, the folding door further includes a positioning component. Referring to FIG. 13, the positioning component includes a clamping member 4 and a fastener 5. The clamping member 4 and the fastener 5 are fixedly provided on opposite folding faces of the second door leaf 17 and the first door leaf 16, respectively, in order to fix the relative position of the two adjacent door leaves in the folded state.

When in use, as shown in FIG. 2:

a. the door leaves are closed, and the central column 9 and the upright column 10 are locked relative to the door frame by the latches in the direction of wind pressure;

b. the latch bolt at the upper position, the middle position and the lower position is unlocked by the lock handle 7, and the first door leaf 16 is rotated and folded at 90°;

c. by operating the positioning handle, the upper latch 190 and the lower latch 191 controlled by the positioning handle 15 are opened, and the second door leaf 17 and the third door leaf 18 are controlled to leave the original fixed rails by the handle 8;

d. the first door leaf 16 is pushed horizontally, and the second door leaf 17 and the third door leaf 18 are also pushed to a position perpendicular)(90° to a side of the door frame; and e. now, the folding door leaves are completely folded.

In order to realize better waterproof effect of the folding door, referring to FIGS. 3, 6, 14 and 15, joints of the door leaves with the heat insulating glass are sealed by glass gaskets 62 to realize water resistance and energy conservation. A drip edge profile 110 is provided on an outer side face of the upper frame 11 in order to prevent rain from permeating into the inner side of the door leaves along the door frame. Drainage holes 6 are formed on an outer side face of the lower frame 12, and the drainage holes 6 are communicated with a water collector of the lower frame 12 to drain accumulated water in the lower frame 12. A drainage hole cover 60 is provided on the drainage holes 6 to prevent rain from flowing back when in a typhoon. Gaskets 61 on the bottoms of the door leaves are located at positions where the door leaves adjoin the door frame, so that the outside surface of the lower frame 12 is covered when the door leaves are completely closed. Accordingly, while realizing the water resistance, the pressure in the water collector is the same as that outside the water collector, so that it is advantageous for the drainage of accumulated water, and the wind resistance, water resistance and energy conservation effects of the folding door are improved.

Figure 16:
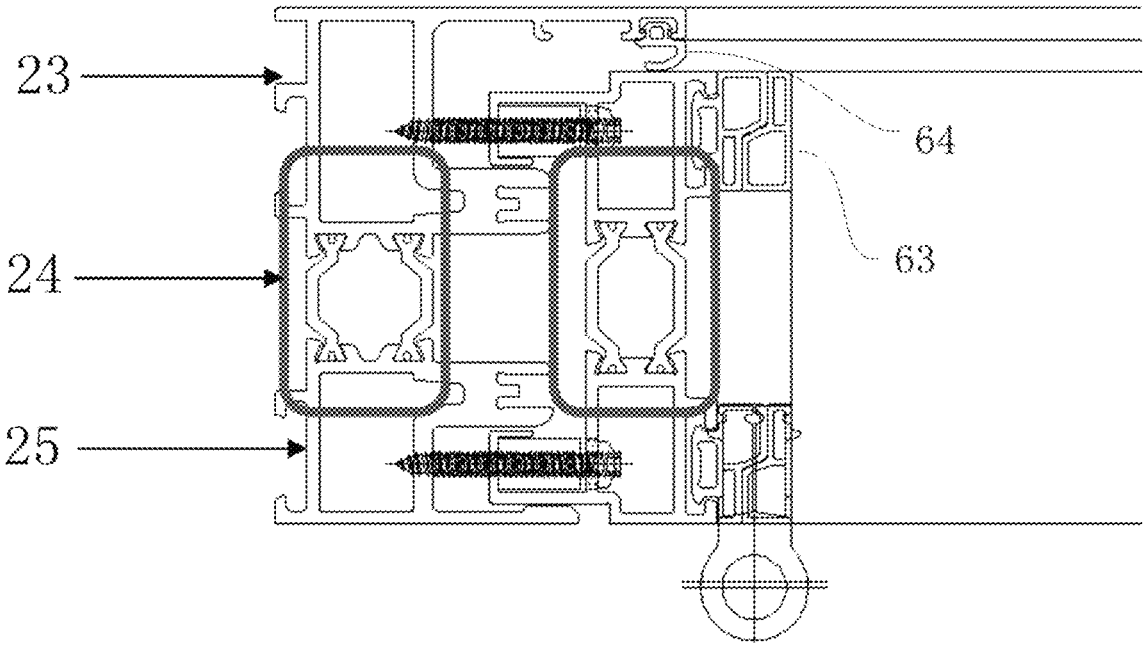
FIG. 16 is a schematic structure diagram of a heat insulating thermal-break aluminum profile according to an embodiment of the present invention.
Figure 17:
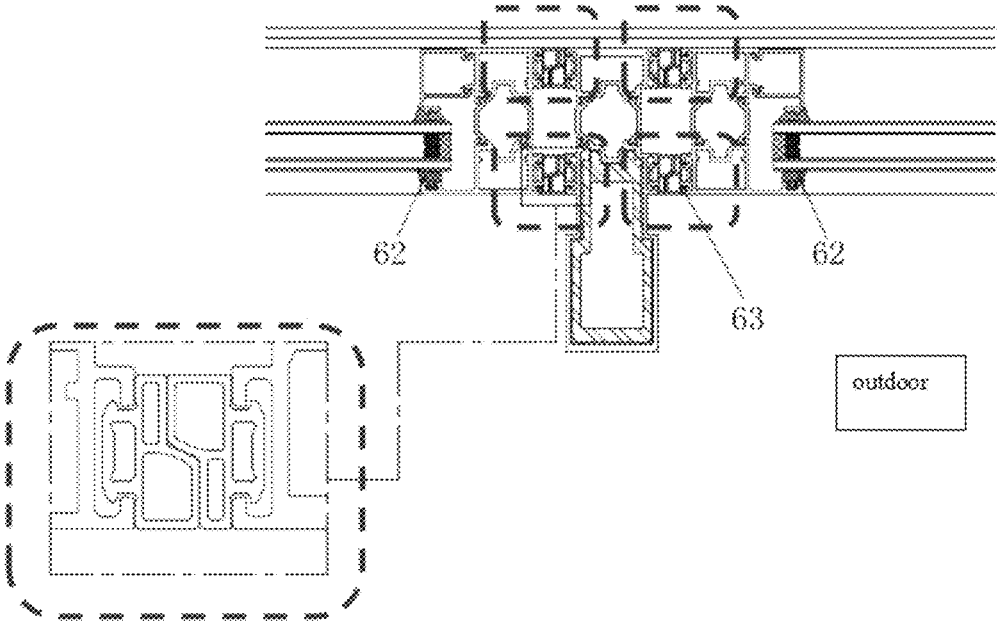

In some embodiments, based on the above embodiment, the main structure of the door frame and the door leaves, and the connecting column are preferably made of thermal-break aluminum profile. Specifically, as shown in FIG. 16, the thermal-break aluminum profile includes an inner aluminum profile 23, a heat insulating bar 24 and an outer aluminum profile 25. The heat insulating bar 24 is located between the inner aluminum profile 23 and the outer aluminum profile 25 to form a three-cavity structure. The inner aluminum profile 23 and the outer aluminum profile 25 can realize different colors of indoor and outdoor aluminum profiles, or can realize the uniformity of the color of the external wall and the indoor decoration. Meanwhile, the heat preservation and heat insulation performances are improved, and the sound insulation and noise reduction effects of the whole folding door are also improved. Waterproof frame gaskets 64 are mounted and compressed by clamps, so that the waterproof effect becomes better. Referring to FIG. 17, by using clamps, interlocked compression gaskets 63 are transversely or vertically mounted inside gaps formed when the folding door is closed. Better fixation and sealing effects are realized by the mutually matched structure of inner and outer interlocked compression gaskets 63. Therefore, in the case of a big difference in air pressure, water penetration can be avoided, and the waterproof and energy-saving effects of the folding door are further improved.

Of course, the folding door structure of the present invention is not limited to implementations as doors, and can also be implemented as windows. The implementations as windows shall also fall into the protection scope of the present invention.

It should be understood by a person of ordinary skill in the art that improvements or transformations to the above description are possible, and all the improvements and transformations shall fall into the protection scope defined by the appended claims of the present invention.

Although the inventive patent has been described illustratively above, apparently, the implementations of the inventive patent is not limited by the above implementations. Various improvements obtained by using the method concepts and technical solutions of the inventive patent or direct application of the concepts and technical solutions of the inventive patent in other occasions without any improvement shall fall into the protection scope of the present invention.

What is claimed is:

1. A folding door structure, comprising: a fixed frame, an upper slide and a lower slide located on the fixed frame, and a plurality of door leaves sandwiched between the upper slide and the lower slide; wherein the folding door structure further comprises an upright column, an upper sliding bracket, a lower sliding bracket and a first lock component;

the plurality of door leaves are hinged with the upright column;

the upper sliding bracket is located at an upper end of the upright column and comprises an upper pulley and an upper fixed seat, and the upper pulley is fixedly arranged on the upper fixed seat and slidingly provided in the upper slide;

the lower sliding bracket is located at a lower end of the upright column and comprises a lower pulley and a lower fixed seat, and the lower pulley is fixedly arranged on the lower fixed seat and slidingly provided in the lower slide;

both the upper fixed seat and the lower fixed seat are fixedly arranged on the upright column, and the upright column is sandwiched between the upper slide and the lower slide through the upper pulley and the lower pulley; and the first lock component comprises a first latch, which is mounted inside the upright column, and both ends of which are extended out from a top end and a bottom end of the upright column to insert into the upper slide and/or the lower slide.

2. The folding door structure according to claim 1, further comprising a central column and a second lock component; two opposite sides of the central column are hinged to the door leaves, respectively; the second lock component comprises a second latch and a switch handle; and, the second latch is located within the central column, and the switch handle is located outside the central column, in order to control the second latch to extend out from an end of the central column and then insert into the upper slide and/or the lower slide when the door leaves are closed;

wherein at least two of the plurality of door leaves are hinged to the upright column and two of the door leaves are hinged to opposite sides of the central column.

3. The folding door structure according to claim 1, wherein the upper slide comprises an upper guide groove in an inverted U-shape; the upper sliding bracket comprises a left upper sliding bracket and a right upper sliding bracket; the left upper sliding bracket comprises a left upper guide pulley and a left upper fixed seat, with the left upper guide pulley being fixedly arranged on the left upper fixed seat; the right upper sliding bracket comprises a right upper guide pulley and a right upper fixed seat, with the right upper guide pulley being fixedly arranged on the right upper fixed seat; the left upper fixed seat and the right upper fixed seat are symmetrical in an inverted L-shape and are symmetrically fixed on two opposite wide sides of the upright column; the left upper guide pulley and the right upper guide pulley are arranged in a line and slidingly provided in the upper guide groove; the first latch comprises a first upper latch; and, an extended head of the first upper latch is located in a middle part of the left upper guide pulley and the right upper guide pulley and resisted against an inner side face of the upper guide groove.

4. The folding door structure according to claim 1, wherein the lower slide comprises a lower guide groove in a U-shape; tops of two side walls of the lower guide groove are installed with slide rails; the lower sliding bracket comprises a left lower sliding bracket and a right lower sliding bracket; the left lower sliding bracket comprises a left lower pulley and a left lower fixed seat, with the left lower pulley being fixedly arranged on the left lower fixed seat; the right lower sliding bracket comprises a right lower pulley and a right lower fixed seat, with the right lower pulley being fixedly arranged on the right lower fixed seat; the left lower fixed seat and the right lower fixed seat are symmetrical in an h-shape and are symmetrically fixed on two opposite wide sides of the upright column; each of the left lower pulley and the right lower pulley comprises a lower guide pulley and two lower bearing rollers; the lower guide pulleys are arranged in a line and slidingly provided in the lower guide groove, and the lower bearing rollers are slidingly provided in the lower guide rails; the first latch comprises a first lower latch; and, an extended head of the first lower latch is located in a middle part of the left lower pulley and the right lower pulley and resisted against an inner side face of the lower guide groove.

5. The folding door structure according to claim 1, wherein the upper sliding bracket further comprises an upper hinge sheet which is hinged to the upper fixed seat and fixedly connected to the door leaves; and/or, the lower sliding bracket further comprises a lower hinge sheet which is hinged to the lower fixed seat and fixedly connected to the door leaves.

6. The folding door structure according to claim 1, wherein the upright column is of a thermal-break aluminum profile structure comprising an outer cavity, a middle cavity and an inner cavity, and the first latch is mounted in the middle cavity.

7. The folding door structure according to claim 6, further comprising a reinforcement core which is located in the outer cavity to reinforce the upright column.

8. The folding door structure according to claim 2, wherein the central column is of a thermal-break aluminum profile structure comprising an outer cavity, a middle cavity and an inner cavity and the second latch is mounted inside the middle cavity; and the folding door structure further comprises a reinforcement core which is located in the outer cavity to reinforce the central column.

9. The folding door structure according to claim 1, further comprising a positioning component which is fixedly provided on folded opposite faces of two adjacent door leaves of the plurality of door leaves to fix the relative position of the two adjacent door leaves when the door leaves are folded.

10. The folding door structure according to claim 1, wherein a drip edge profile is provided on an outer side of an upper portion of the fixed frame, and drainage holes are formed on an outer side face of a lower portion of the fixed frame.

11. The folding door structure according to claim 1, wherein gaskets for sealing the folding door comprise interlocked compression gaskets.

* * * * *